US012084992B2

(12) United States Patent
Khatri

(10) Patent No.: US 12,084,992 B2
(45) Date of Patent: Sep. 10, 2024

(54) CLEAN ELECTRICITY GENERATING SYSTEM AND METHOD

(71) Applicant: Kantilal Khatri, Chaguanas (TT)

(72) Inventor: Kantilal Khatri, Chaguanas (TT)

( * ) Notice: Subject to any disclaimer, the term of this patent is extended or adjusted under 35 U.S.C. 154(b) by 0 days.

(21) Appl. No.: 18/321,178

(22) Filed: May 22, 2023

(65) Prior Publication Data

US 2024/0151164 A1 May 9, 2024

Related U.S. Application Data

(60) Provisional application No. 63/422,574, filed on Nov. 4, 2022.

(51) Int. Cl.

| | |
|---|---|
| ***F01K 25/10*** | (2006.01) |
| ***F01K 7/16*** | (2006.01) |
| ***F01K 11/02*** | (2006.01) |
| ***F01K 27/00*** | (2006.01) |

(52) U.S. Cl.

CPC ..... *F01K 25/106* (2013.01); *F01K 7/16* (2013.01); *F01K 27/00* (2013.01); *F01K 11/02* (2013.01)

(58) Field of Classification Search

CPC . F01K 25/106; F01K 7/16; F01K 9/00; F01K 11/00; F01K 11/02; F01K 27/00; F01K 27/02; F03G 7/00; F03G 7/045

See application file for complete search history.

(56) References Cited

U.S. PATENT DOCUMENTS

| | | | |
|---|---|---|---|
| 7,157,166 | B2 | 1/2007 | Vajo |
| 8,464,515 | B2 | 6/2013 | Aso |
| 8,887,690 | B1 | 11/2014 | Sturman |
| 9,249,720 | B2 | 2/2016 | Miyagawa |
| 2010/0288249 | A1 | 11/2010 | Sasaki |
| 2011/0011354 | A1 | 1/2011 | Dincer |

FOREIGN PATENT DOCUMENTS

| | | | | |
|---|---|---|---|---|
| AT | 503167 | B1 * | 10/2007 | F01K 25/08 |
| CN | 108518249 | A * | 9/2018 | F01D 15/10 |
| DE | 202009016763 | U1 * | 5/2010 | F01K 27/00 |
| GB | 2441343 | A * | 3/2008 | F03G 6/064 |
| WO | WO-2008068491 | A2 * | 6/2008 | F01K 21/00 |

* cited by examiner

*Primary Examiner* — Mark A Laurenzi
*Assistant Examiner* — Xiaoting Hu
(74) *Attorney, Agent, or Firm* — Brennan, Manna & Diamond, LLC

(57) ABSTRACT

The present invention is a novel system for generating renewable or pollution reducing electricity. The system does not use burning of hydrocarbons for producing electricity and comprises a heating chamber and a cooling chamber, wherein insulated walls enclose each chamber. The heating chamber contains two or more infrared electric heaters to heat the ammonia in the pipelines that run into and along the heated chamber along with the turbines. Each turbine is configured to be connected to a generator to produce electricity from the stored kinetic energy created by the turbine. The cooling chamber includes an air-cooling device to bring down the temperature of the ammonia vapor and to liquify the vapor. The system improves environmental consciousness by offering a renewable/pollution reducing energy source rather than burning fossil fuels.

19 Claims, 4 Drawing Sheets

CLEAN ELECTRICITY GENERATING SYSTEM AND METHOD

CROSS-REFERENCE TO RELATED APPLICATION

The present application claims priority to, and the benefit of, U.S. Provisional Application No. 63/422,574, which was filed on Nov. 4, 2022, and is incorporated herein by reference in its entirety.

FIELD OF THE INVENTION

The present invention relates generally to the field of electricity generating system. More specifically, the present invention relates to a novel system for generating electricity without burning hydrocarbons. The system uses ammonia to rotate turbines and produce electricity using the kinetic energy of the rotating turbines. The system uses heated and cooling chamber for subjecting ammonia to high temperature and pressure for creating vapors. Accordingly, the present disclosure makes specific reference thereto. Nonetheless, it is to be appreciated that aspects of the present invention are also equally applicable to other like applications, devices, and methods of manufacture.

BACKGROUND

By way of background, hydrocarbons are typically used for producing electricity via various fuel mixtures. In fact, combustion of hydrocarbons is currently the main source of the world's energy for electric power generation, heating, and transportation. Hydrocarbons are naturally occurring and form the basis of crude oil, natural gas, coal, and other important energy sources. Hydrocarbons also serve as fuels and lubricants as well as raw materials for the production of plastics, fibers, rubbers, solvents, explosives, and industrial chemicals.

The combustion of hydrocarbon fuels releases carbon dioxide (CO2), as well as other greenhouse gases that contribute to atmospheric pollution and climate change. Unlike fossil fuel impurities that result in byproduct emissions, CO2 is an unavoidable result of hydrocarbon combustion. Specifically, burning hydrocarbons in the presence of oxygen (O2) produces carbon dioxide (CO2) and water (H2O). If there is too much carbon or too little oxygen present when hydrocarbons are burned, carbon monoxide (CO) may also be emitted. Burning of hydrocarbons, pollute the air, damage land, and degrade the environment via greenhouse gas emission and leave a very serious and dangerous carbon footprint. People desire a new way of producing electricity that does not cause pollution and improves environmental consciousness.

Therefore, there exists a long-felt need in the art to produce electricity in an environmentally friendly manner. There is also a long-felt need in the art for a system that generates electricity, but does not cause pollution and does not increase the carbon footprint. Additionally, there is a long-felt need in the art for an electricity generating system that obviates burning of hydrocarbons. Moreover, there is a long-felt need in the art for a device that uses clean and recyclable electricity. Further, there is a long-felt need in the art for electricity generating systems that can be used in place of thermal plants. Finally, there is a long-felt need in the art for electricity generating systems that use ammonia which is a renewable energy source to produce electricity.

The subject matter disclosed and claimed herein, in one embodiment thereof, comprises a system for generating renewable or pollution reducing electricity. The system comprises a heated chamber and a cooling chamber, wherein insulated walls enclose each chamber, the heated chamber is positioned on top of the cooling chamber and contains two or more infrared electric heaters to heat the ammonia in the pipelines running or extending into the heated chamber, a plurality of turbines are connected by the pipelines, the turbines are connected to a storage tank positioned in the cooling chamber via the pipelines, the turbines with integrated generators produce electricity from the kinetic energy of the rotating turbines wherein the rotation is caused by high temperature and high-pressure ammonia residing inside the turbines.

In this manner, the green electricity generating system of the present invention accomplishes all of the forgoing objectives and provides users with specialized turbines that use ammonia to produce electricity. The system improves environmental consciousness by offering a renewable, or pollution reducing, energy source rather than burning fossil fuels. Ammonia at high temperature and pressure is used for producing kinetic energy which is used for producing electricity.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a green electricity generating system. The system is used for generating electricity from ammonia and further comprising an insulating heating chamber, an insulating cooling chamber, the heating chamber is positioned on top of the cooling chamber, a plurality of turbines interconnected through a plurality of pipes, the plurality of turbines positioned inside the heating chamber, a storage tank positioned inside the cooling chamber, a plurality of infrared electric heaters integrated to the heating chamber for increasing temperature of the heating chamber, an air-cooling device integrated to the cooling chamber for cooling down the temperature of the storage tank, the plurality of pipes are culminating to the distal end of the storage tank, wherein, ammonia inside the turbines is subjected to high temperature and high-pressure to form vapor for rotating the turbines to produce kinetic energy that produces electricity, and the vapor travels along the plurality of pipes to the storage tank to liquify for evacuation from the system.

In yet another embodiment, heating chamber has a temperature in the range of 90-100 degrees Celsius and the ammonia passing through the turbines is subjected to a temperature in the range of 400-500 degrees Celsius.

In yet another embodiment, the system does not produce carbon dioxide or any other greenhouse gases.

The subject matter disclosed and claimed herein, in one embodiment thereof, comprises a method of forming or generating electricity from ammonia. The method comprising the steps of subjecting ammonia to high temperature and high-pressure inside a plurality of turbines, the plurality of turbines are interconnected through a plurality of pipelines;

converting the ammonia into high temperature vapor for rotating the plurality of turbines; converting kinetic energy of the rotating turbines into electricity; providing generated electricity to external units; and, cooling down the hot ammonia vapors in a storage tank to liquify the vapor, wherein the plurality of pipelines carry the vapor into the storage tank.

In yet another embodiment, the method uses a compressor for regulating pressure of the ammonia inside the turbines.

In yet another embodiment, a system for generating renewable or pollution reducing electricity is disclosed. The system comprises a heated chamber and a cooling chamber, wherein insulated walls enclose each chamber, the heated chamber contains two or more infrared electric heaters to heat the ammonia in the pipelines running in the heated chamber, a plurality of turbines are connected by the pipelines, the turbines are connected to a storage tank positioned in the cooling chamber via the pipelines, the turbines with integrated generators produce electricity from the kinetic energy of the rotating turbines wherein the rotation is caused by high temperature and high-pressure ammonia inside the turbines.

In yet another embodiment, the renewable or pollution reducing electricity generating system of the present invention easily and efficiently manufactures electricity in an environment conscious manner without creating pollution.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
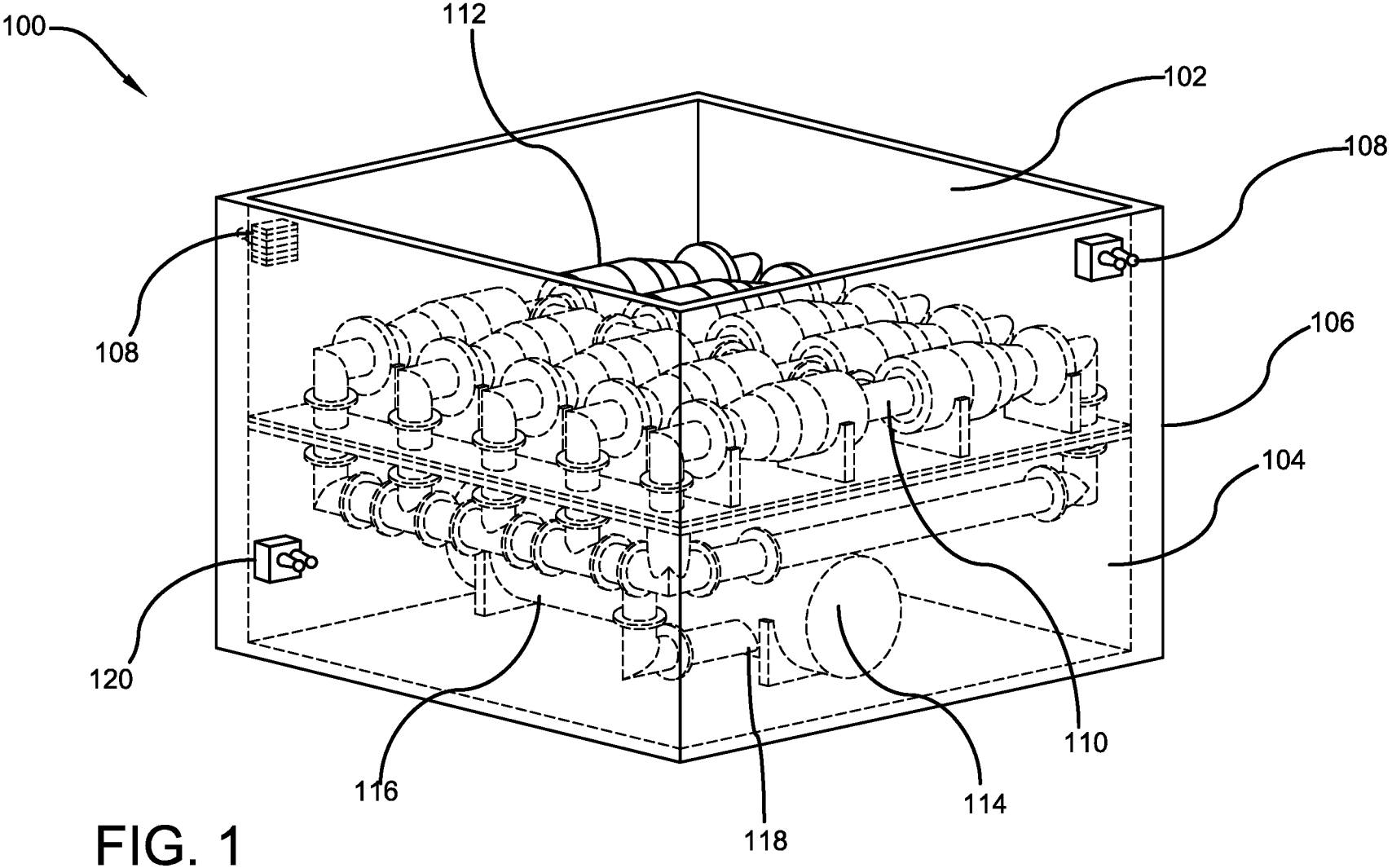
FIG. 1 illustrates a perspective view of one potential embodiment of renewable or pollution reducing electricity production or generating system of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art to produce electricity in an environmentally friendly manner. There is also a long-felt need in the art for a system that generates electricity, but does not cause pollution and does not increase carbon footprint. Additionally, there is a long-felt need in the art for electricity generating systems that obviate burning of hydrocarbons. Moreover, there is a long-felt need in the art for a device that uses clean and recyclable electricity. Further, there is a long-felt need in the art for electricity generating systems that can be used in place of thermal plants. Finally, there is a long-felt need in the art for electricity generating systems that use ammonia which is a renewable energy source to produce or generate electricity.

The present invention, in one exemplary embodiment, is a green electricity generating system. The system is used for generating electricity from ammonia and not hydrocarbons and further comprising an insulating heating chamber, an insulating cooling chamber, the heating chamber is positioned on top of the cooling chamber, a plurality of turbines interconnected through a plurality of pipes, the plurality of turbines positioned inside the heating chamber, a storage tank positioned inside the cooling chamber, a plurality of infrared electric heaters integrated to the heating chamber for increasing temperature of the heating chamber, an air-cooling device integrated to the cooling chamber for cooling down the temperature of the storage tank, the plurality of pipes are culminating at the distal end of the storage tank, wherein, ammonia inside the turbines is subjected to high temperature and high-pressure to form vapor for rotating the turbines to produce kinetic energy that produces electricity, and the vapor travels along the plurality of pipes to the storage tank to liquify for evacuation from the system.

Referring initially to the drawings, FIG. 1 illustrates a perspective view of one potential embodiment of a renewable or pollution reducing electricity production or generating system of the present invention in accordance with the disclosed architecture. The renewable or pollution reducing electricity production or generating system 100 of the present invention is designed to produce electricity from ammonia without causing any pollution. The system 100 includes a heating chamber 102 and a cooling chamber 104, wherein the heating chamber 102 is preferably positioned on top of the cooling chamber 104. The chambers 102, 104 are enclosed by a plurality of insulating walls 106 for preventing flow of temperature across the chambers 102, 104 and the external environment. The size of the chambers 102, 104 can be defined based on the power of electricity required to product. The heating chamber 102 has two or more infrared electric heaters 108 for blowing hot air in the chamber 102 and to heat the ammonia as described in detail later in the disclosure.

The heating chamber 102 has a network of pipelines 110 along with integrated ammonia turbines 112. The turbines 112 are connected to the pipelines 110 and are used for processing liquid ammonia to form ammonia vapor. The two or more infrared electric heaters 108 heat the ammonia in the pipelines 110 that extend into the heated chamber 102 along with the turbines 112. The turbines 112 are configured to be rotated by the high-temperature and high-pressure ammonia vapor flowing through them and through the pipeline network 110 for generating electricity. The kinetic energy due to rotation of the turbines 112 are stored and is used for generating electricity without production of any harmful carbon dioxide and other greenhouse gases. In one exemplary embodiment, each turbine has an associated or integrated generator for producing electricity and can produce any of the AC or DC electricity as per requirements of the users.

The cooling chamber 104 is configured to lower the temperature of the ammonia vapor received from the heating chamber 102 to liquify the hot ammonia vapor. The temperature is lowered using an integrated air-cooling device 120. The vapor is liquified while going through the common pipeline 116 and in the storage tank 114. The pipeline network 110 is connected to a storage tank 114 positioned in the cooling chamber 104 such that the condensed ammonia vapor from each of the turbines 112 is directed into the storage tank 114. More specifically, all the pipelines 110 are merged into a single common pipeline 116 connected to the distal end 118 of the storage tank 114. The electricity producing system 100 of the present invention does not emit $CO_2$ and ammonia as a raw product is widely used worldwide as fertilizer and chemical raw material, and its mass transportation by ship and rail is well-established.

Figure 2:
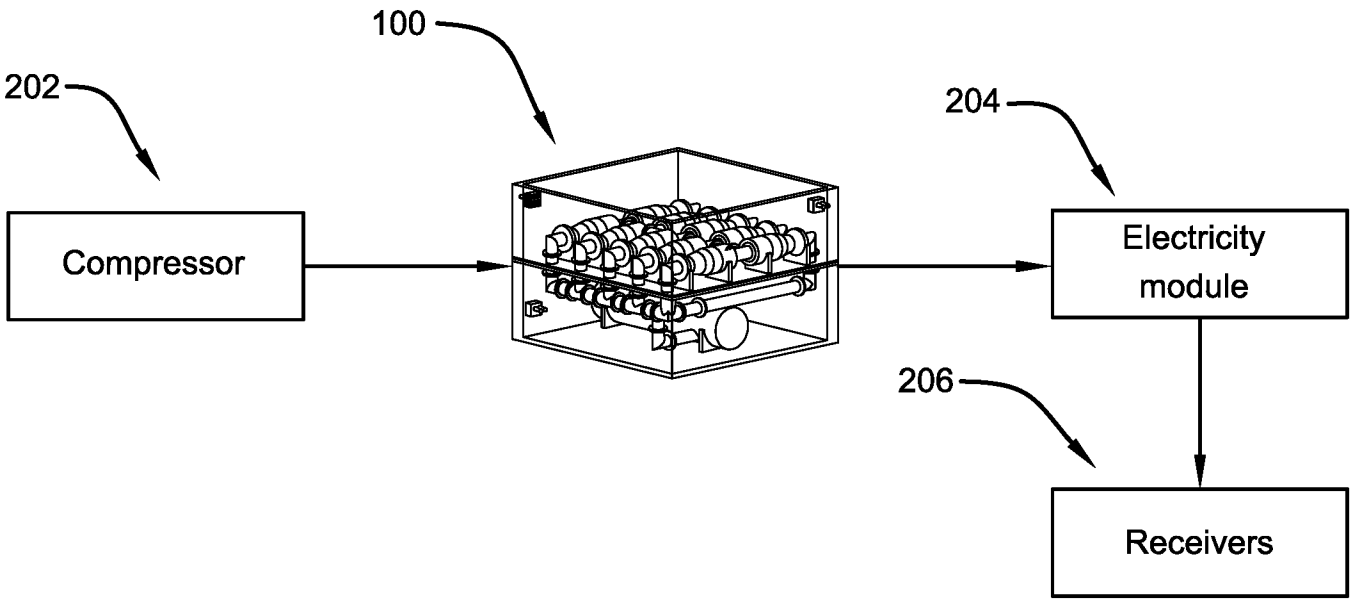
FIG. 2 illustrates a functional block diagram of the renewable or pollution reducing electricity production or generating system along with additional essential components in accordance with the disclosed architecture.

FIG. 2 illustrates a functional block diagram of the renewable or pollution reducing electricity production or generating system 100 along with additional essential components in accordance with the disclosed architecture. The system 100 also uses a compressor 202 in conjunction (i.e., fluid communication) with the pipeline network 110 for regulating pressure in the turbines 112. The compressor 202 is configured to create a high-pressure in the inlet ammonia and the pressure can be adjusted based on the ambient temperature produced by the infrared electric heaters 108 in the heating chamber 102. An electricity module 204 is designed to provide electricity generated by the system 100 to electric receivers 206 which can be in the form of electric plants and more.

The heated chamber 102 has an ambient temperature of 90-100 degrees Celsius produced by the infrared electric heaters 108. Preferably, a power output of 20-50 kilowatts (kW) from the infrared electric heaters 108 are used in the system 100. The turbines 112 have a temperature range of 400-500 degrees Celsius thereby producing rotation in the turbines 112 for generating electricity. The electricity module 204 is in the form of a connector for connecting the system 100 with external units for providing clean and green electricity.

Figure 3:
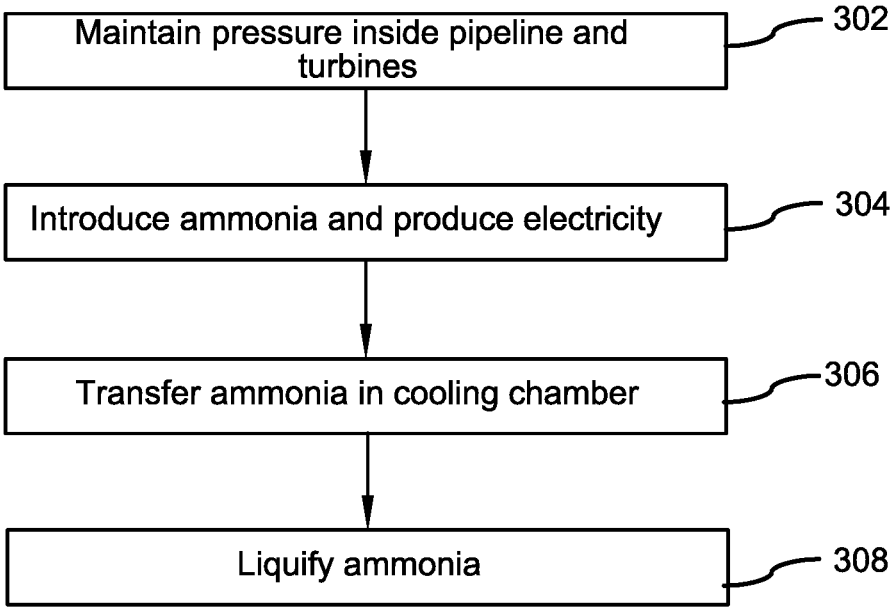
FIG. 3 illustrates a flow diagram depicting a process of operating the green electricity production or generating system of the present invention in accordance with the disclosed architecture.

FIG. 3 illustrates a flow diagram depicting a process of operating the green electricity production or generating system 100 of the present invention in accordance with the disclosed architecture. Initially, a desired pressure is maintained and regulated inside the pipelines and turbines positioned in the heating chamber of the system (Step 302). The pressure can be regulated automatically or can also be done manually by an operator. Thereafter, ammonia is introduced in the pipeline allowing the gas to become a high temperature and high-pressure vapor for rotating the turbines to produce electricity (Step 304). Then, the electricity produced is transferred to an external unit and in parallel, the vapor is stored in the storage tank positioned inside the cooling chamber (Step 306). Finally, the vapor is liquified for evacuating from the system, thereby producing no carbon dioxide or other greenhouse effect gases (Step 308).

Figure 4:
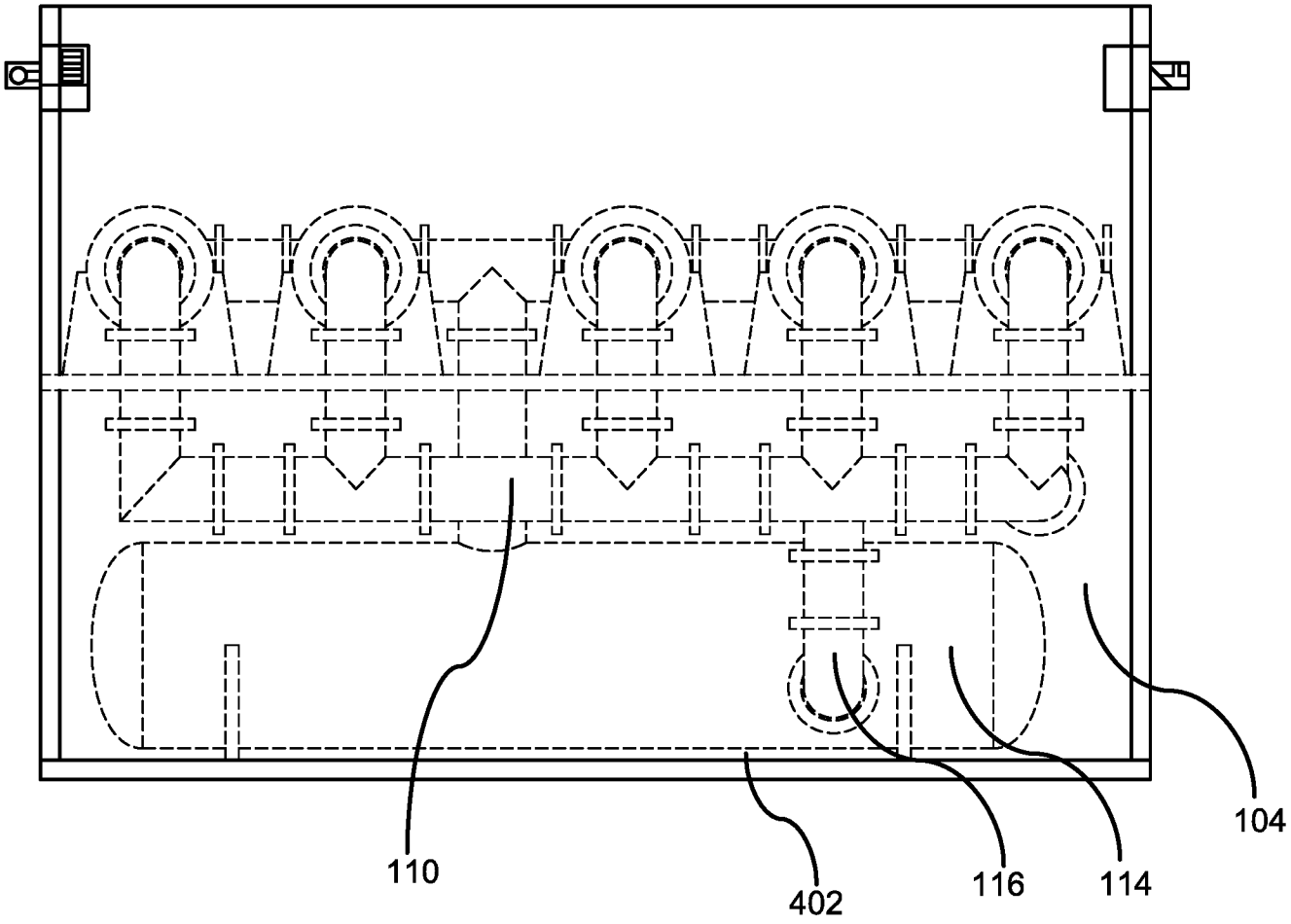
FIG. 4 illustrates a rear view of the renewable or pollution reducing electricity production or generating system of the present invention in accordance with the disclosed architecture.

FIG. 4 illustrates a rear view of the renewable or pollution reducing electricity production or generating system of the present invention in accordance with the disclosed architecture. The storage tank 114 is positioned on the bottom surface 402 of the cooling chamber 104 for storing and cooling the ammonia vapor. All the pipelines 110 terminate into the common pipeline 116 for transferring the vapor to the storage tank 114. As illustrated, the heated chamber 102 and the cooling chamber 104 have a common insulating wall separating the chambers 102, 104.

The system 100 of the present invention can work under different combinations of the pressure and temperature with ammonia used as a medium for producing electricity. The tables given below describe different specifications of the system 100 as per the present disclosure. The specific enthalpy is equal to the specific internal energy of the system plus the product of pressure and specific volume. Specific enthalpy (h) is defined as h=u+Pv, where u is the specific internal energy (Btu/lbm) of the system. P is the pressure of the system (lbf/ft$^2$), and v is the specific volume (ft$^3$/lbm) of the system. Specific entropy is the entropy per unit mass of the system. The units of entropy are kj/K, and for specific entropy kJ/kgK. Entropy is a property of the state of the system, and the change in entropy in going from an initial to a final state is independent of the path taken.

TABLE 1

| Specification | | |
|---|---|---|
| Medium | Ammonia | |
| State of Aggregation | Fluid | |
| Pressure | 10.03 | [bar] |
| Temperature | 24 | degrees Celsius |
| Density Fluid | 604.2686 | kg/m$^3$ |
| Specific Enthalpy Fluid | 312.9218 | kJ/kg |
| Specific Entropy Fluid | 1.39285 | kJ/kgK |

TABLE 2

| Specification | | |
|---|---|---|
| Medium | Ammonia | |
| State of Aggregation | Fluid | |
| Pressure | 10 | [bar] |
| Temperature | 24 | degrees Celsius |
| Density Fluid | 604.248 | kg/m$^3$ |
| Specific Enthalpy Fluid | 313 | kJ/kg |
| Specific Entropy Fluid | 1.39218 | kJ/kgK |

TABLE 3

| Specification | | |
|---|---|---|
| Medium | Ammonia | |
| State of Aggregation | Fluid | |
| Pressure | 10 | [bar] |
| Temperature | 10 | degrees Celsius |
| Density Fluid | 604.9 | kg/m$^3$ |
| Specific Enthalpy Fluid | 246.8 | kJ/kg |
| Specific Entropy Fluid | 1.165 | kJ/kgK |

TABLE 4

| Specification | |
|---|---|
| Medium | Ammonia |
| State of Aggregation | Fluid |
| Pressure | 10 [bar] |
| Temperature | 4 degrees Celsius |
| Density Fluid | 633.36 kg/m$^3$ |
| Specific Enthalpy Fluid | 218.96 kJ/kg |
| Specific Entropy Fluid | 1.06486 kJ/kgK |

TABLE 5

| Specification | |
|---|---|
| Medium | Ammonia |
| State of Aggregation | Boiling curve |
| Pressure | 10.032 [bar] |
| Temperature | 25 degrees Celsius |
| Density fluid | 602.76 kg/m$^3$ |
| Density gas | 7.8069 kg/m$^3$ |
| Specific Enthalpy fluid | 317.7 kJ/kg |
| Specific Enthalpy gas | 1483 kJ/kg |
| Specific Entropy fluid | 1.409 kJ/kgK |
| Specific Entropy gas | 5.319 kJ/kgK |

TABLE 6

| Specification | |
|---|---|
| Medium | Ammonia |
| State of Aggregation | Fluid |
| Pressure | 11 [bar] |
| Temperature | 25 degrees Celsius |
| Density Fluid | 602.836203 kg/m$^3$ |
| Specific Enthalpy Fluid | 317.76 kJ/kg |
| Specific Entropy Fluid | 1.40850 kJ/kgK |
| Cp | 4.783335 kJ/kgK |

TABLE 7

| Specification | |
|---|---|
| Medium | Ammonia |
| State of Aggregation | Fluid |
| Pressure | 62.2 [bar] |
| Temperature | 100 degrees Celsius |
| Density Gas | 55.491057 kg/m$^3$ |
| Specific Enthalpy Gas | 1439.76 kJ/kg |
| Specific Entropy Gas | 4.50641 kJ/kgK |

TABLE 8

| Specification | |
|---|---|
| Medium | Ammonia |
| State of Aggregation | Boiling curve |
| Pressure | 62.553 [bar] |
| Temperature | 100 degrees Celsius |
| Density fluid | 456.63 kg/m$^3$ |
| Density gas | 56.117 kg/m$^3$ |
| Specific Enthalpy fluid | 721 kJ/kg |
| Specific Enthalpy gas | 1437 kJ/kg |
| Specific Entropy fluid | 2.58 kJ/kgK |
| Specific Entropy gas | 4.497 kJ/kgK |

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "renewable or pollution reducing electricity production or generating system", "electricity production or generating system", "green electricity production or generating system", and "system" are interchangeable and refer to the green electricity production or generating system 100 of the present invention.

Notwithstanding the forgoing, the green electricity production or generating system 100 of the present invention can be of any suitable size and configuration as is known in the art without affecting the overall concept of the invention, provided that it accomplishes the above-stated objectives. One of ordinary skill in the art will appreciate that the green electricity production or generating system 100 as shown in the FIGS. are for illustrative purposes only, and that many other sizes and shapes of the green electricity production or generating system 100 are well within the scope of the present disclosure. Although the dimensions of the green electricity production or generating system 100 are important design parameters for user convenience, the green electricity production or generating system 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An electricity generating system comprising:

a heating chamber;

a plurality of infrared electric heaters; and a cooling chamber enclosed by a plurality of insulating walls;

wherein said heating chamber is positioned on top of said cooling chamber;

wherein said insulating walls prohibit a flow of temperature across said heating chamber and said cooling chamber to an external environment;

wherein said heating chamber has a network of pipelines and integrated ammonia turbines within said heating chamber;

wherein said integrated ammonia turbines process liquid ammonia into ammonia vapor;

wherein said plurality of electric infrared heaters heat said liquid ammonia in said network of pipelines extending into said heating chamber;

wherein said ammonia turbines rotate upon flow of high-temperature and high-pressure ammonia vapor flowing through said ammonia turbines; and further wherein said rotation of said ammonia turbines stores kinetic energy.

2. The electricity generating system of claim 1, wherein said stored kinetic energy generates electricity upon rotation of said ammonia turbines.

3. The electricity generating system of claim 2, wherein said ammonia turbines have integrated generators for producing the electricity upon the rotation of said ammonia turbines.

4. The electricity generating system of claim 2, wherein said heating chamber has a plurality of said infrared electric heaters for blowing hot air into said heating chamber.

5. The electricity generating system of claim 4, wherein said cooling chamber has an integrated cooling unit and a storage tank for lowering the temperature of said ammonia vapor received from said heating chamber to liquify said ammonia vapor.

6. The electricity generating system of claim 5, wherein said cooling chamber has a common pipeline for receiving said ammonia vapor.

7. The electricity generating system of claim 6, wherein said ammonia vapor condenses into a liquid ammonia while going through said common pipeline.

8. The electricity generating system of claim 7, wherein said liquid ammonia is stored in said storage tank.

9. The electricity generating system of claim 8 further comprising a compressor in fluid communication with said pipeline network for regulating a pressure in said ammonia turbines.

10. The electricity generating system of claim 9, wherein said compressor increases a pressure of said ammonia entering said electricity generating system.

11. The electricity generating system of claim 9, wherein said compressor adjusts the pressure of said ammonia entering said electricity generating system.

12. The electricity generating system of claim 1, wherein said electricity generating system includes a medium of said liquid ammonia having a temperature from 4 degrees Celsius to 25 degrees Celsius.

13. The electricity generating system of claim 12, wherein said electricity generating system includes said medium of said liquid ammonia having a pressure from 10 bar to 11 bar.

14. The electricity generating system of claim 13, wherein said electricity generating system includes said medium of said liquid ammonia having a density from 602.76 $kg/m^3$ to 633.36 $kg/m^3$.

15. The electricity generating system of claim 14, wherein said electricity generating system includes said medium of said liquid ammonia having a specific enthalpy from 218.96 KJ/kg to 317.76 KJ/kg.

16. The electricity generating system of claim 15, wherein said electricity generating system includes said medium of said liquid ammonia having a specific entropy from 1.06486 KJ/kgK to 1.40850 KJ/kgK.

17. An electricity generating system comprising:

a heating chamber;

a plurality of infrared electric heaters; and a cooling chamber enclosed by a plurality of insulating walls;

wherein said heating chamber is positioned on top of said cooling chamber;

wherein said insulating walls prohibit a flow of temperature across said heating chamber and said cooling chamber to an external environment;

wherein said heating chamber has a network of pipelines and integrated ammonia turbines within said heating chamber;

wherein said integrated ammonia turbines process liquid ammonia into ammonia vapor;

wherein said plurality of electric infrared heaters heat said liquid ammonia in said network of pipelines extending into said heating chamber;

wherein said ammonia turbines rotate upon flow of high-temperature and high-pressure said ammonia vapor flowing through said ammonia turbines;

wherein said rotation of said ammonia turbines stores kinetic energy;

wherein said ammonia turbines have integrated generators for producing the electricity upon the rotation of said ammonia turbines;

wherein said cooling chamber has an integrated cooling unit, a common pipeline, and a storage tank for lowering the temperature of said ammonia vapor received from said heating chamber to liquify said ammonia vapor;

wherein said liquid ammonia has a temperature from 4 degrees Celsius to 25 degrees Celsius; and further wherein said electricity generating system includes said liquid ammonia under a pressure from 10 bar to 11 bar.

18. The electricity generating system of claim 17, wherein said ammonia vapor condenses into a liquid ammonia while going through said common pipeline.

19. The electricity generating system of claim 18 further comprising a compressor in fluid communication with said pipeline network for regulating a pressure in said ammonia turbines.

* * * * *